United States Patent [19]

Thuries et al.

[11] Patent Number: 4,983,791

[45] Date of Patent: Jan. 8, 1991

[54] HIGH TENSION CIRCUIT BREAKER HAVING A DIELECTRIC BLAST GAS

[75] Inventors: Edmond Thuries, Meyzieu; Denis Dufournet, Bron; Michel Perret, Bourgoin-Jallieu, all of France

[73] Assignee: GEC Alsthom S.A., Paris, France

[21] Appl. No.: 531,367

[22] Filed: May 31, 1990

[30] Foreign Application Priority Data

May 31, 1989 [FR] France ..... 89 07179

[51] Int. Cl.[5] ..... H01H 33/88

[52] U.S. Cl. ..... 200/148 A; 200/148 R

[58] Field of Search ..... 200/148 A, 148 R

[56] References Cited

U.S. PATENT DOCUMENTS 4,945,197 7/1990 Thuries et al. ..... 200/148 A

FOREIGN PATENT DOCUMENTS 3344094 6/1985 Fed. Rep. of Germany .
2576144 7/1986 France .
2610763 8/1988 France .
1178948 1/1970 United Kingdom .

*Primary Examiner*—Robert S. Macon
*Attorney, Agent, or Firm*—Sughrue, Mion, Zinn, Macpeak & Seas

[57] ABSTRACT

A high tension circuit breaker insulated by an arc blasting dielectric gas and comprising, inside a gastight insulating housing: a fixed assembly comprising, in particular, a fixed main contact and a fixed arcing contact; a moving assembly driven by a drive rod and including, in particular, a moving main contact and a moving arcing contact; a blast volume extended by a blast nozzle; a blast piston; and a pair of secondary contacts disposed inside a first volume and intended to generate a secondary arc; wherein the circuit breaker further comprises first means for reducing the risks of unwanted arcs being struck due to the secondary arc, the first means being constituted by a jacket of insulating material extending level with the secondary contacts and in sliding contact with at least a portion of one of the sliding contacts, the jacket having longitudinal grooves adjacent to said secondary contact. The invention is applicable to high tension circuit breakers.

9 Claims, 4 Drawing Sheets

HIGH TENSION CIRCUIT BREAKER HAVING A DIELECTRIC BLAST GAS

The present invention relates to a high tension circuit breaker in which the circuit breaking chamber is filled with a dielectric gas such as sulfur hexafluoride ($SF_6$) in which the energy of the arc is used, by virtue of the increase in pressure it confers on the gas, firstly to blast the arc which is struck when the circuit breaker opens, and secondly to provide additional energy to the mechanism for opening the circuit breaker.

These objects can be obtained, for example, by providing the circuit breaker with an additional pair of contacts capable of generating a secondary arc during circuit breaker opening.

BACKGROUND OF THE INVENTION

A circuit breaker of this type is described, for example, in French patent application number 88 03 803, filed Mar. 23, 1988.

An object of the present invention is to provide a circuit breaker of the above-mentioned type which, while retaining its qualities of requiring little drive energy on opening, associated with excellent efficiency in arc blasting, also requires little drive energy on closing and is provided with means for preventing untimely breakdown and arc striking inside the circuit breaking chamber.

SUMMARY OF THE INVENTION

The present invention provides a high tension circuit breaker insulated by an arc blasting dielectric gas and comprising, inside a gastight insulating housing:

- a fixed assembly comprising, in particular, a fixed main contact and a fixed arcing contact;
- a moving assembly driven by a drive rod and including, in particular, a moving main contact and a moving arcing contact;
- a blast volume extended by a blast nozzle;
- a blast piston; and
- a pair of secondary contacts disposed inside a first volume and intended to generate a secondary arc;
- wherein the circuit breaker further comprises first means for reducing the risks of unwanted arcs being struck due to the secondary arc, said means being constituted by a jacket of insulating material extending level with the secondary contacts and in sliding contact with at least a portion of one of the sliding contacts, said jacket having longitudinal grooves adjacent to said secondary contact.

The circuit breaker may also include means for limiting the length of the secondary arc.

Advantageously, said means comprises a fixed metal block disposed on the path of the end of the moving secondary contact.

The circuit breaker includes second means for conveying additional energy to contribute to closing, by virtue of the secondary contacts prestriking.

Preferably, said second means include ducts providing communication between said first volume and said blast volume, said communication being closable by a differential valve disposed in the blast volume.

In a particular embodiment, said blast piston separates said blast volume and said first volume, said communication taking place through said piston.

Said blast piston includes second ducts providing second communication between said blast volume and a second volume outside said first volume and said blast volume, said second communication being closable by a piston urged by a spring, said piston being constrained to move only when the circuit breaker is interrupting low value currents.

Advantageously, said secondary contacts are provided with horns for extending the secondary arc.

Said secondary contacts are brought to the same potential at the end of a circuit breaking operation.

BRIEF DESCRIPTION OF THE DRAWINGS

Embodiments of the invention are described by way of example with reference to the accompanying drawings, in which.

DETAILED DESCRIPTION

Figure 1:
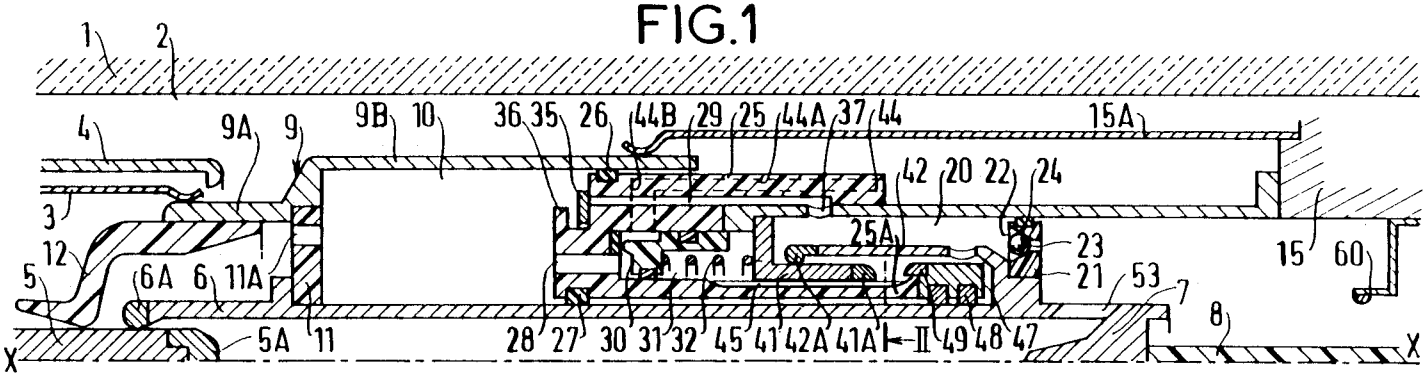
FIG. 1 is a diagrammatic fragmentary axial half section through a circuit breaker of the invention shown in the engaged position.

In FIG. 1, reference 1 designates a cylindrical housing of insulating material (such as a ceramic) about an axis xx, the housing delimiting an inside volume 2 which is filled with a gas having good dielectric properties, e.g. sulfur hexafluoride ($SF_6$).

The circuit breaker comprises a fixed main contact 3 constituted by contact fingers disposed in an annular tulip-like configuration; this contact is surrounded by an anti-corona cap 4. The main contact 3 is associated with a fixed arcing contact constituted by a metal tube 5 terminated by a part 5A which withstands the effects of arcing and which is made, for example, of pure or alloyed tungsten. The two abovementioned fixed contacts are connected to a first current terminal (not shown).

The moving equipment of the circuit breaker comprises a metal tube 6 terminated by a wear part 6A constituting the moving arcing contact. This tube is connected by a metal part 7 to an axial rod 8 made of insulating material and used for providing drive during opening and closing operations of the circuit breaker.

The moving equipment further includes a part 9 in the form of two adjacent cylinders gA and gB which are coaxial and of different diameters: the smaller diameter cylinder 9A serves as a moving permanent contact and to this end it co-operates with the contact fingers 3. Together with the tube 6, the larger diameter cylinder 9B delimits a blast volume 1O. The parts 9 and 6 are interconnected by an annular part 11 made of insulating material and pierced by passages 11A. The tube 9A carries a blast nozzle 12 made of insulating material.

The end of the fixed assembly furthest from the blast zone situated at the end of the nozzle comprises a fixed metal block 15 which is electrically connected to a second current terminal (not shown). The block 15 carries a ring of contact fingers 15A co-operating with the tube 9 to ensure continuity of current flow between the tube 9 and the block 15.

The block 15 also carries a metal tubular part 16 which together with the tube 6 defines an annular volume 20. This volume is closed at a first end by an insulating annular part 21 provided with openings 22 capable of being closed by non-return valves 23 preventing gas from flowing from the inside towards the outside of the volume 20. The part 21 is fixed to the moving tube 6 and slides along the tube 16 in sealed manner by virtue of a dynamic seal 24. The other end of the volume 20 is closed by a part 25 made of insulating material which serves as the blast piston in co-operation with the cylinder 9. This part 25 is fixed to the tube 16. It carries a dynamic seal 26 co-operating with the tube 9B and a sliding seal 27 co-operating with the tube 6. The part 25 is generally tubular in shape having sufficient thickness to enable it to include first and second ducts 28 and 29 running parallel to the axis xx and each putting the volumes 10 and 20 into communication. The ducts 28 can be closed by a piston 30 sliding in a volume 31 formed in the part 25 adjacent to the volume 20. The piston 30 is pushed in a direction tending to close the ducts 28 by a spring 28 bearing against a fixed portion of the circuit breaker and described below. The ducts 29 may be closed adjacent to the volume 10 by a differential valve 35 constituted by a single annular washer whose stroke is limited by an abutment 36. The ducts 29 extend beyond the zone of overlap between the parts 25 and the tube 16. Holes 37 through the tube 16 allow communication to take place between the ducts 29 and the inside of the volume 20.

The tube 16 carries a first contact 41 of a pair of secondary contacts. The contact 41 serves as an abutment to the spring 32. This contact 41 is terminated by a wear part 41A which is tubular in shape.

The tube 6 carries the second contact 42 of the pair of secondary contacts. This contact 42 is likewise tubular in shape and is terminated by a wear part 42A. It is coaxial with the contact 41. When the circuit breaker is in the closed position (as shown in FIG. 1), the contacts 41 and 42 overlap to a large extent.

The part 25 has channels 44 which put the volume 10 into communication with the volume 2 when the piston 30 is not closing the channels 28. The major portion 44A of the channels 44 runs parallel to the axis xx. These channels have radial portions 44B opening out into the vicinity of the outlets of the channels 28.

Figure 2:
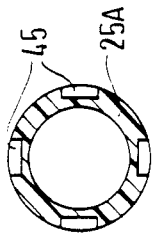
FiG. 2 is a cross-section on line II—II of FIG. 1.

In accordance with an important characteristic of the invention, the part 25 is extended adjacent to the axis xx by a tubular portion or jacket 25A of insulating material which is in sliding contact with a portion of the secondary contact 41. Adjacent to the contact 41, the jacket 25A has longitudinal grooves 45, i.e. grooves extending parallel to the axis xx and visible in FIG. 2. In the example shown, the insulating part 25 and the jacket 25A constitute a single machined part.

The end of the part 25 closest to the drive rod carries a metal block 47 which co-operates electrically with the tube 6 via sliding electrical contacts 48. The block carries a ring 49 of material that withstands the effects of arcing, the diameter of the ring being substantially equal to that of the tube 41 and the ring being directed towards the wear part on the tube 41.

The circuit breaker operates as follows:

In the engaged position (FIG. 1) current flows via the fingers 3 of the main contact, the tube 9, the contact fingers 15A, and the metal block 15.

Interrupting low value currents

These are currents which are no greater in value than the nominal value of current in the line in which the circuit breaker is inserted.

On disengagement, the operating rod 8 is displaced to the right in the figure and drives the moving equipment. The main contacts separate and current is switched to the arcing contacts. Current then flows via the tube 5, the tube 6, the tube 42, the tube 41, the tube 16, and the block 15.

Figure 3:
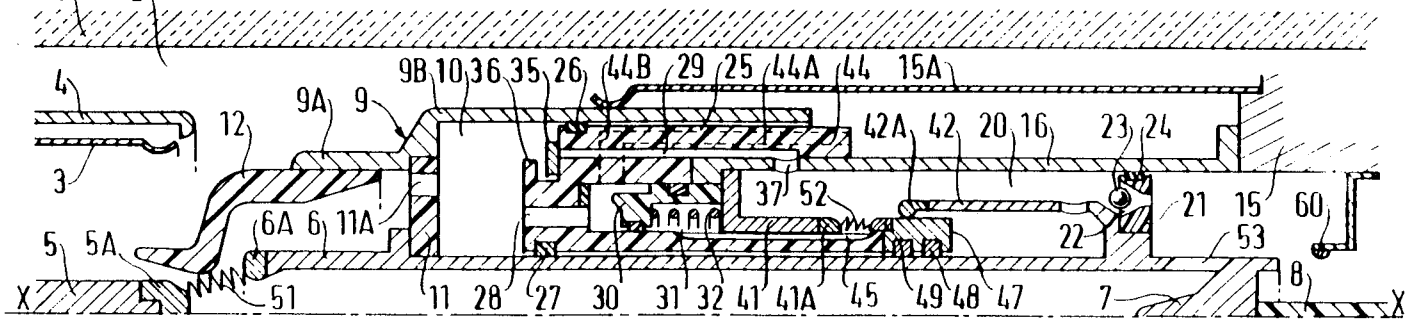
FIG. 3 is a view of the same circuit breaker during an opening operation for interrupting a low value of current.

When the arcing contacts 5 and 6 separate, which coincides with the secondary contacts 41 and 42 separating, an arc 51 is struck between the contacts 5 and 6, and an arc 52 is struck between the contacts 41 and 42 (see FIG. 3). Since the current to be interrupted is low, the heating power of the arc 52 is also low. The non-return valve 23 is open and allows the volume 20 to be filled. The increase in pressure in the blast volume 10 is due mainly to the effect of the compression produced by displacing the piston 25 in the cylinder 10. This increase in pressure causes the arc 51 to be blasted. The excess pressure is evacuated via the ducts 28, 44B and 44A to the volume 2. The increase in pressure in the volume 10 causes the piston 30 to move against the action of the spring 31 and in spite of the small rise in pressure caused by the secondary arc 52. The valve 35 is also closed by the excess pressure in the volume 10 during the circuit breaker opening operation. The excess pressure inside the tube 6 may be exhausted via holes 53 formed therethrough beyond the part 21.

At the end of the operation, the tube 6 is brought to the potential of the block 15 by means of contact fingers 60.

By virtue of the presence of the metal block 47, the secondary arc 52 does not stretch beyond a given length equal to the distance between the parts 41A and 49. This prevents any danger of an arc striking on the surrounding metal walls. Unwanted arc strikes are prevented by the jacket 25A. Friction against the contact part 41 causes a certain amount of wear and a small amount of carbonization of the insulating material which favors ionization in the surrounding medium and which consequently directs the arc and causes it to be channeled along the grooves 45.

Interrupting high value currents

These are short circuit currents.

Figure 4:
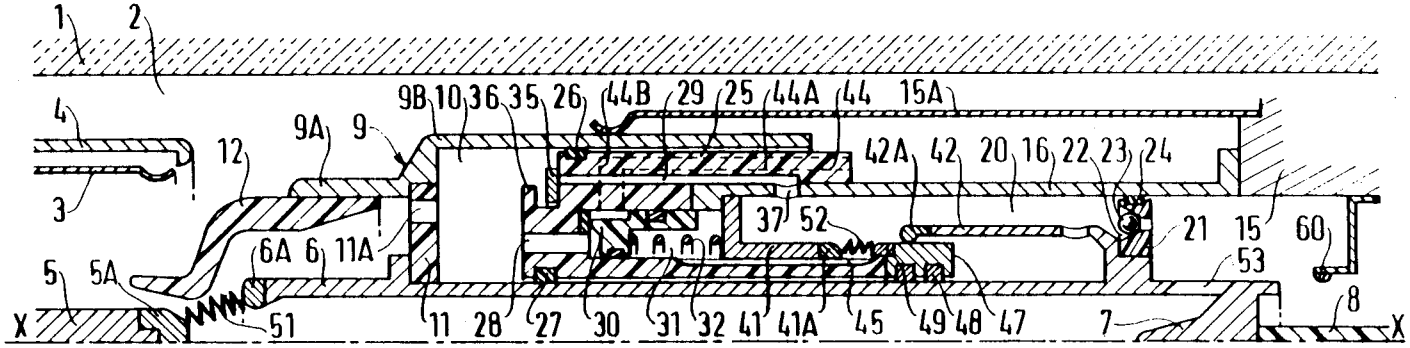
FIG. 4 is a view of the same circuit breaker during an opening operation for interrupting a high value current.

The secondary arc 52 (FIG. 4) generates a large amount of heat, thereby raising the pressure P3 in the volume 20 to a considerable extent. The non-return valve 23 closes. The hot gases in the volume 20 pass along the grooves 45 and cause the channels to be closed by the piston 30. The differential valve 35 also closes since the force of the pressure P2 in the volume 10 on the total area S1 of the valve 35 is higher than the force of the pressure P3 in the volume 20 on the area S2 of the ducts 29 The pressure in the blast volume thus becomes very high since the gas cannot escape therefrom. On the first zero crossing of the current, the gas in the volume 10 expands and provides an extremely energetic blast of the arc 51 which is extinguished, thereby extinguishing the secondary arc 52. During the displacement of the moving equipment, the pressure P3 in the volume 20 bears against the area of the part 21 thus providing a major contribution to the drive energy.

Closing the circuit breaker

Figure 5:
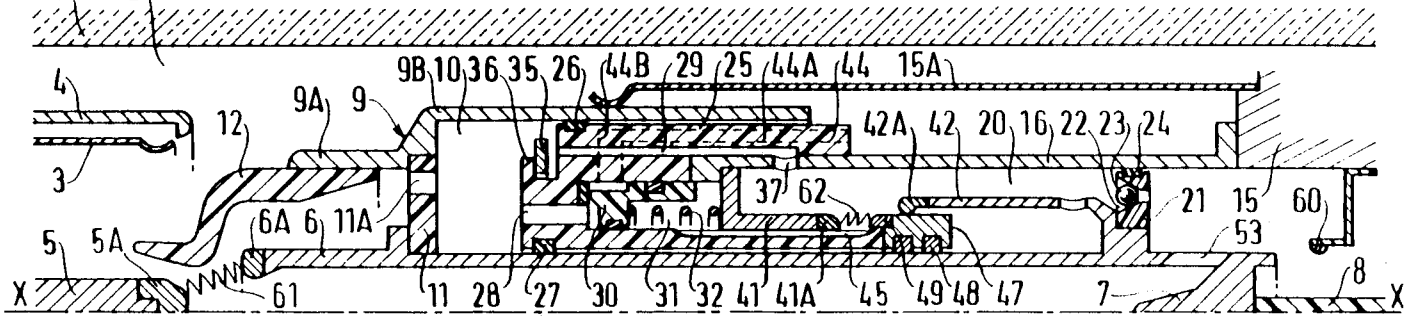
FIG. 5 is a view of the same circuit breaker during a closing operation.

Reference is made to FIG. 5.

The moving assembly is displaced from the right towards the left in the figure. When the main arcing contacts and the secondary arcing contacts have moved towards each other to a distance which is less than the isolation distance, prestrike arcs 61 and 62 appear. The non-return valve 23 is closed. The increase in pressure generated by the secondary arc 62 causes the piston 30 to close and the differential valve 35 to open. The pressure P4 in the volume 20 is thus conveyed via the ducts 29 to the part 11 and the connecting portion of the tubes 9A and 9B, thereby contributing to the closure energy.

The circuit breaker of the invention, of which one embodiment is described above, is very reliable in operation because of the measures taken to avoid internal arcs being struck. The dispositions taken to make use of the secondary arc provide a major contribution towards the drive energy required for interrupting high value currents. Arcing is allowed on closure, but there too it contributes towards providing drive energy.

Figure 6:
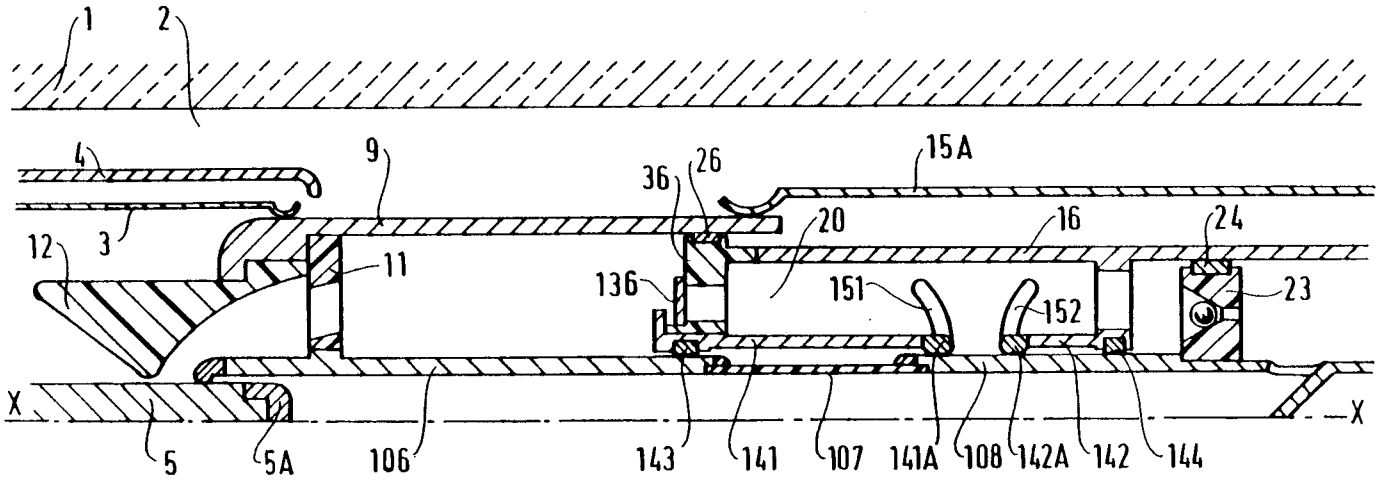
FIG. 6 is a diagrammatic axial half-section through a variant embodiment of a circuit breaker of the invention shown in the engaged position.
Figure 7:
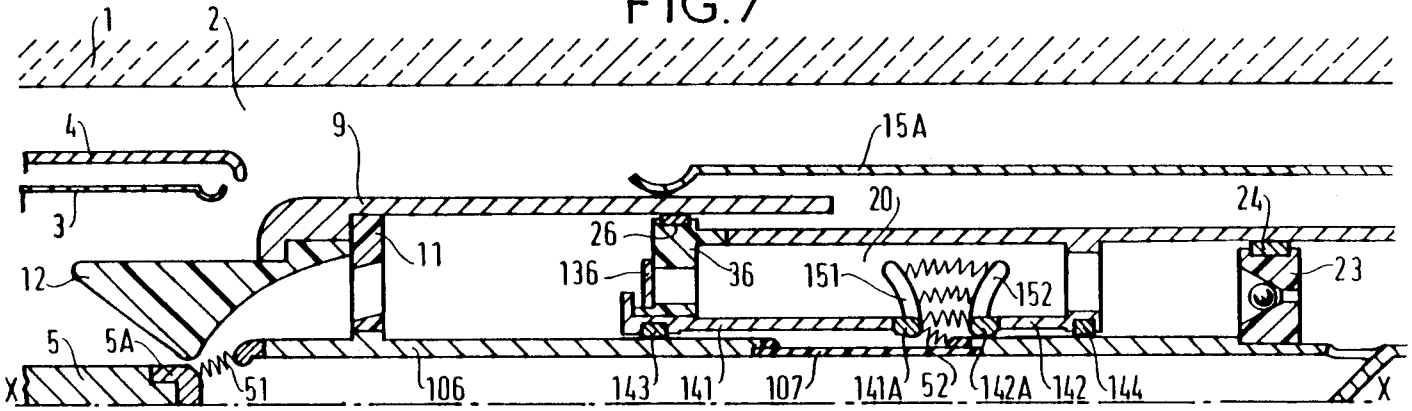
FIG. 7 is a view of the same circuit breaker at the beginning of a disengagement operation.
Figure 8:
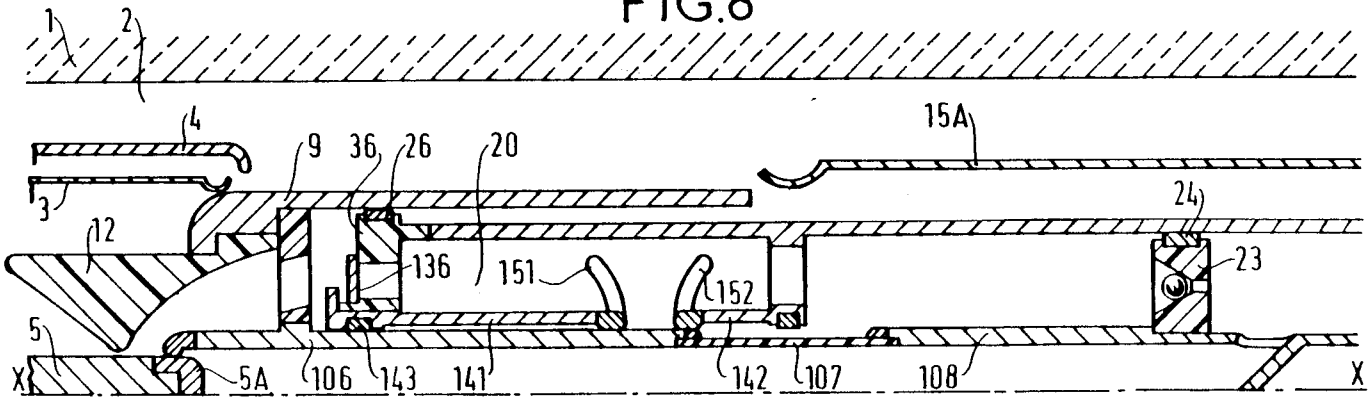
FIG. 8 is a view of the same circuit breaker at the end of the disengagement operation.

FIGS. 6 to 8 show a variant embodiment of the invention which is simpler in structure. Items that are common to these figures and to the preceding figures are given the same reference numerals and are not described again.

The moving arcing contact is a metal tube 106 extended by an insulating tube 107 itself extended by a metal tube 108 connected to the drive rod.

One of the secondary contacts 141 is fixed to the piston 36 and is in electrical contact with the tube 106 via a sliding contact 143.

The other secondary contact 142 is fixed to the tube 16 and co-operates electrically with the tube 108 via a sliding electrical contact 144.

The openings in the piston 36 are closable by means of a non-return valve constituted by a ring 136.

According to a characteristic of this variant embodiment, the ends of the secondary contacts are provided with horns 151 and 152 whose function is described below.

When in the engaged position (FIG. 6), current flows through the circuit breaker via the parts 3, 9, and 15A.

While disengaging, and after the arcing contacts have separated (FIG. 7), a main arc 51 and a secondary arc 52 develop. The secondary arc 52 is driven by electromagnetic forces to rise along the horns and to lengthen, thereby increasing the heating of the surrounding gas and the rise in pressure in the volume. The energy delivered by the secondary arc is thus increased and facilitates disengagement.

At the end of the disengagement operation (FIG. 8), the rounded ends 141A and 142A of the secondary contacts 151 and 152 come into contact with the tube 106 so that they are both brought to the same potential.

The variant described above is simple in construction, robust, and is applicable, like the preceding variant, to high tension circuit breakers.

The presence of the insulating tube 107 improves the channelling of the secondary arc and prevents untimely arcs being struck.

We claim:

1. A high tension circuit breaker insulated by an arc blasting dielectric gas and comprising, inside a gastight insulating housing:

a fixed assembly comprising, in particular, a fixed main contact and a fixed arcing contact;

a moving assembly driven by a drive rod and including, in particular, a moving main contact and a moving arcing contact;

a blast volume extended by a blast nozzle;

a blast piston; and a pair of secondary contacts disposed inside a first volume and intended to generate a secondary arc;

wherein the circuit breaker further comprises first means for reducing the risks of unwanted arcs being struck due to the secondary arc, said means being constituted by a jacket of insulating material extending level with the secondary contacts and in sliding contact with at least a portion of one of the sliding contacts, said jacket having longitudinal grooves adjacent to said secondary contact.

2. A circuit breaker according to claim 1, including means for limiting the length of the secondary arc.

3. A circuit breaker according to claim 2, wherein the said means comprises a fixed metal block disposed on the path of the end of the moving secondary contact.

4. A circuit breaker according to claim 1, including second means for conveying additional energy to contribute to closing, by virtue of the secondary contacts prestriking.

5. A circuit breaker according to claim 4, wherein said second means include ducts providing communication between said first volume and said blast volume, said communication being closable by a differential valve disposed in the blast volume.

6. A circuit breaker according to claim 1, wherein said blast piston separates said blast volume and said first volume, said communication taking place through said piston.

7. A circuit breaker according to claim 6, wherein said blast piston includes second ducts providing second communication between said blast volume and a second volume outside said first volume and said blast volume, said second communication being closable by a piston urged by a spring, said piston being constrained to move only when the circuit breaker is interrupting low value currents.

8. A circuit breaker according to claim 1, wherein said secondary contacts are provided with horns for extending the secondary arc.

9. A circuit breaker according to claim 8, wherein said secondary contacts are brought to the same potential at the end of a circuit breaking operation.

* * * * *